United States Patent [19]

Kasai

[11] Patent Number: 4,894,890

[45] Date of Patent: Jan. 23, 1990

[54] BUCKLE ASSEMBLY

[75] Inventor: Kazumi Kasai, Namerikawa, Japan

[73] Assignee: Yoshida Kogyo K. K., Tokyo, Japan

[21] Appl. No.: 253,552

[22] Filed: Oct. 5, 1988

[30] Foreign Application Priority Data

Oct. 6, 1987 [JP] Japan ..... 62-153121[U]

[51] Int. Cl.[4] ..... A44B 11/25

[52] U.S. Cl. ..... 24/573; 24/625; 24/656

[58] Field of Search ..... 24/573, 574, 625, 589, 24/323, 656, 630

[56] References Cited

U.S. PATENT DOCUMENTS

| | | | |
|---|---|---|---|
| 3,364,532 | 1/1968 | Hatfield . | |
| 3,845,524 | 11/1974 | Hull et al. | 24/573 |
| 4,335,728 | 1/1982 | Fildan . | |
| 4,559,679 | 12/1985 | Downey | 24/574 X |

FOREIGN PATENT DOCUMENTS

| | | |
|---|---|---|
| 1937518 | 3/1970 | Fed. Rep. of Germany . |
| 86-15094.4 | 8/1986 | Fed. Rep. of Germany . |
| 542837 | 10/1921 | France . |
| 86598 | 1/1966 | France . |
| 2403042 | 9/1978 | France . |
| 62-24721 | 2/1987 | Japan . |
| 228725 | 12/1943 | Switzerland . |
| 1182751 | 3/1970 | United Kingdom . |
| 2079833 | 1/1982 | United Kingdom . |

*Primary Examiner*—James R. Brittain

*Attorney, Agent, or Firm*—Hill, Van Santen, Steadman & Simpson

[57] ABSTRACT

A buckle assembly composed of three components, i.e. a retainer base, a plug and a socket for releasably connecting three belts or straps. The retainer base has an aperture for receiving therein an upstanding generally C-shaped locking lug to connect the retainer base and the socket. The plug is slidably mounted on the retainer base and having a pair of resilient legs snappingly engageable with the locking lug to releasably couple the retainer base and the socket. With this construction, the buckle assembly can be assembled easily without a tedious and time consuming positional adjustment between the plug and the socket. The snap-fit between the resilient legs and the locking lug insures a firm coupling engagement between the retainer base and the socket.

15 Claims, 5 Drawing Sheets

BUCKLE ASSEMBLY

BACKGROUND OF THE INVENTION

1. Field of the Invention

The present invention relates generally to buckles for releasably connecting belts on various articles such as helmets, life jackets and rucksacks, and more particularly to a buckle assembly composed of three structural components adapted to be coupled together to connect three strap end portions.

2. Description of the Prior Art

A typical buckle assembly of the type described is disclosed in Japanese Utility Model Laid-open Publication No. 62-24721. The disclosed buckle assembly is composed of three structural components, i.e. a rectangular base attached to a first belt and having a transverse aperture or window, a socket attached to a second belt and having an upwardly projecting C-shaped locking lug, and a planar plug attached to a third belt. To assemble the buckle assembly, the C-shaped locking lug of the socket is inserted into the aperture in the base, then the plug is forced into an opening in the C-shaped locking lug to couple the base and the socket, thereby connecting the first to third belt.

The known buckle assembly is however disadvantageous in that since the base and the plug are structurally separated from one another, a tedious positional adjustment is required when the plug is inserted in the C-shaped locking lug, resulting in a time consuming coupling operation of the buckle assembly A further drawback is that the plug is flat and only force-fitted with the C-shaped locking lug. The thus constructed plug is likely to be detatched from the locking lug when it is pulled away from the socket. As a result, a firm interlocking engagement between the base and the socket is difficult to obtain.

SUMMARY OF THE INVENTION

With the foregoing drawbacks in review, it is accordingly an object of the present invention to provide a buckle assembly including a retainer base, a socket and a plug which can be assembled together quickly with utmost ease and can be retained firmly in assembled condition against accidental detachment.

According to the present invention, there is provided a buckle assembly for releasably connecting three belts and including a retainer body for being attached to a first belt, a plug for being attached to a second belt, and a socket for being attached to a third belt. The retainer base has an aperture into which an upstanding generally C-shaped locking lug is received to connect the retainer body and the socket. The plug is slidably mounted on the retainer body and has a pair of resilient legs snappingly engageable with the C-shaped locking lug. The plug is slidably movable between a first position in which the resilient legs are retracted from the aperture to allow movement of the locking lug into and out of the aperture, and a second position in which said resilient legs are disposed across the aperture to snappingly engage with the locking lug, thereby coupling the retainer base and the socket.

With this construction, the plug slidably mounted on the retainer base can easily be coupled with the locking lug of the socket without the necessity of a tedious and time-consuming positional adjustment. Further, the resilient legs snap-fitted with the locking lug ensures that the retainer base and the socket are firmly held in coupled condition against accidental separation.

Many other advantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION

Figure 1:
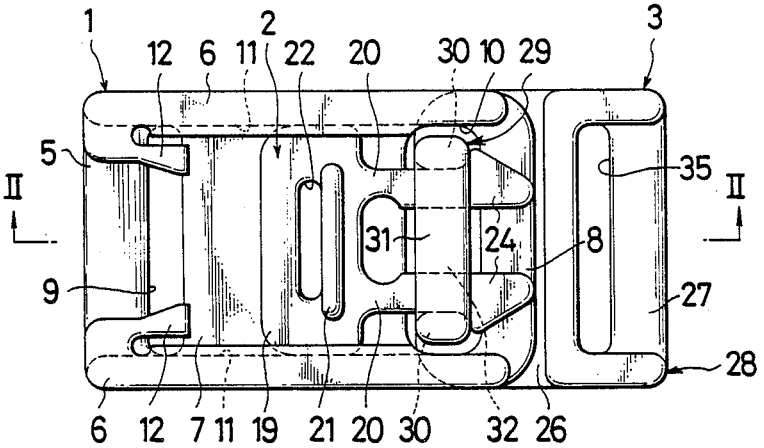
FIG. 1 is a plan view of a buckle assembly according to the present invention.

Certain preferred structural embodiments of the present invention will be described hereinafter in detail with reference to the accompanying drawings, in which like or corresponding parts are denoted by like or corresponding reference characters throughout several views.

Figure 2:
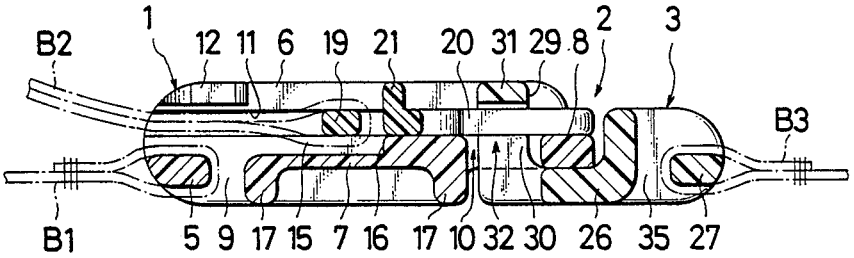
FIG. 2 is a cross-sectional view taken along line II—II of FIG. 1.

As shown in FIGS. 1 and 2, a buckle assembly embodying the present invention is composed of three structural components, i.e. a retainer base 1, a plug 2 movably mounted on the base 1, and a socket 3 connected by the plug 2 to the retainer base 1. The retainer base 1, the plug 2 and the socket 3 are molded of synthetic resin.

Figure 3:
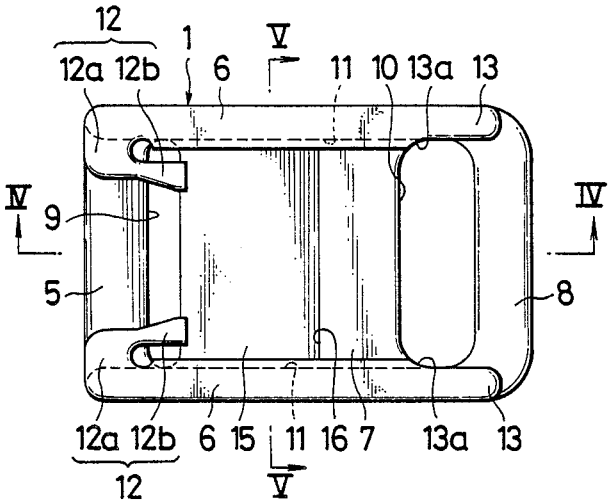
FIG. 3 is a plan view of a retainer base of the buckle assembly.
Figure 4:
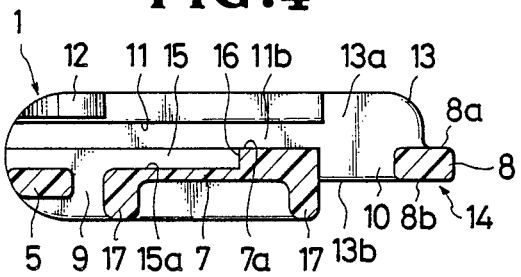
FIG. 4 a cross-sectional view taken along line IV—IV of FIG. 3.
Figure 5:
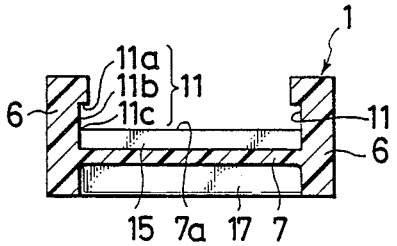
FIG. 5 is a cross-sectional view taken along line V—V of FIG. 3.

The retainer base 1, as shown in FIGS. 3 through 5, has a generally rectangular shape including a transverse connecting bar 5, a pair of parallel spaced longitudinal side plates 6, 6 extending perpendicularly from the opposite ends of the connecting bar 5 in a common direction, and a transverse guide bar 8 interconnecting front ends of the side plated 6, 6 remote from the connecting bar 5. The retainer base 1 further includes a central support plate 7 extending transversely between the side plates 6, 6 and disposed between the connecting bar 5 and the guide bar 8 with a transverse slit 9 and a transverse aperture 10 defined respectively between the connecting bar 5 and the support plate 7 and between the support plate 7 and the guide bar 8. The slit 9 is provided for the passage there through of a first belt B1 (indicated by phantom lines in FIG. 2) while the aperture 10 is provided for receiving a generally C-shaped locking lug, described later, of the socket 3.

The side plates 6 project upwardly from the connecting bar 5, the support plate 7 and the guide bar 8 and include a pair of longitudinal guide grooves 11, 11, respectively, extending in their confronting inner side surfaces. Each of the guide grooves 11 is defined jointly by and between an upper horizontal wall 11*a*, a vertical side wall 11*b* and a lower horizontal wall 11*c*. The guide grooves 11 extend longitudinally of the respective side plates 6 between the rear edge of the connecting bar 5 and the front edge of the support plate 7 adjacent to the guide bar 8 for slidably receiving therein a head portion, described later, of the plug 2. Each of the side plates 6 has a generally L-shaped integral stopper 12 projecting inwardly from the rear end of the side plate 6. The L-shaped stopper 12 is disposed above the guide groove 11 and includes a base portion 12*a* projecting inwardly from the side plate 6 toward the base portion 12*a* of the opposite side plate 6, and an arm 12*b* extending from an inner end of the base portion 12*a* toward the front end of the side plate 6 in parallel spaced relation to the side plate 6. The base portion 12*a* is disposed above the connecting bar 5 and the arm 12*b* terminates in a front end face lying substantially flush with the rear edge of the support plate 7. The side plate 6 includes a thin front end portion 13 having an inner surface 13*a* extending in flush with the vertical side wall 11*b* of the guide groove 11 for facilitating easy reception of the head portion of the plug 2 into the guide grooves 11. The front end portion 13 is cut out at its underside so as to provide a stepped retainer portion 14 extending between the front edge of the support plate 7 and the rear edge of the guide bar 8, the retainer portion 14 lying flush with the lower surface of the guide bar 8. With the stepped retainer portion 14 thus provided, the front end portions 13 are smaller in height than the remainder of the respective side plates 6 to which the connecting bar 5 and the support plate 7 are joined.

The support plate 7 is disposed immediately below the guide grooves 11 in the side plates 6 and has a length slightly smaller than the length of the plug 2. The support plate 7 has in its upper surface a recessed portion 15 extending from the rear edge toward the front edge of the support plate 7 and terminating at a vertical shoulder 16 extending transversely throughout the width of the support plate 7. The recessed portion 15 has a depth greater than the thickness of a second belt B2 (indicated by phantom lines in FIG. 2) so that the second belt B2 as it is secured to the plug 2 is loosely received in the recessed portion 15. The vertical shoulder 16 is displaced closer to the front edge than to the rear edge of the support plate 7 and is engageable with the second belt B2 to prevent the plug 2 from projecting forwardly beyond the front edge of the guide bar 8 when the plug 2 is forced to slide toward the guide bar 8. The thus-recessed support plate 7 has an upper surface 7*a* extending substantially in flush with the lower horizontal surfaces 11*c* of the guide grooves 11. The upper surface 15*a* of the recessed lies in a plane below the guide grooves 11. The support plate 7 includes a pair of projections 17, 17 projecting downwardly from the front and rear edges of the support plate 7 so as to define therebetween a space or recess for receiving therein the user's finger when the plug 2 is moved along the guide grooves 11.

The guide bar 8 has an upper surface 8*a* extending in flush with the upper surface 7*a* of the support plate 7 and a lower surface 8*b* extending in flush with a lower surface 13*b* of the notched front end portion 13 of each side plate 6. The guide bar 8 slightly projects forwardly from the front edges of the side plates 6 for guiding the plug 2 when the latter is inserted into the guide grooves 11.

The retainer base 1 is secured to the first belt B1 by looping a belt end around the connecting bar 5 from the underside of the latter and then stitching the looped belt end to the web of the belt B1 as shown in FIG. 2.

Figure 6:
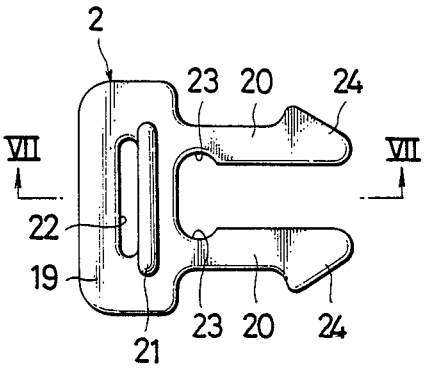
FIG. 6 is a plan view of a plug of the buckle assembly.
Figure 7:
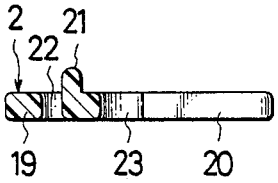
FIG. 7 is a cross-sectional view taken along line VII—VII of FIG 6.

The plug 2, as shown in FIGS. 6 and 7, includes a generally rectangular head portion 19 and a pair of parallel spaced resilient locking legs 20, 20 extending from the head portion 19 in a common direction. The plug 2 has a length smaller than the distance between the rear edge of the connecting bar 5 and the front edge of the support plate 7.

The head portion 19 has a width substantially the same as or slightly smaller than the distance between the guide grooves 11 so that the head portion 19 is guidely receivable in the guide grooves 11. The head portion 19 includes a transverse abutment ridge 21 projecting from an upper surface thereof and engageable with the stoppers 12 of the retainer base 1. The head portion 19 further has a transverse slit 22 for the passage therethrough of a second belt B2 (indicated by phantom lines in FIG. 2), the slit 22 extending alongside the abutment ridge 21. The slit 22 is positioned such that the slit 22 is held in vertical alignment with the slit 9 in the retainer base 1 when the abutment ridge 21 engages the stoppers 12, 12.

The resilient legs 20 extend perpendicularly from one side edge of the rectangular head portion 19 and hence extend parallel to the side plates 6 of the retainer base 1 when the plug 2 is mounted on the retainer base 1. The resilient legs 20 have a length such that the legs 20 do not project forwardly beyond the front edge of the support plate 7 when the abutment ridge 21 is brought into abutment with the stoppers 12. The resilient legs 20 have a pair of confronting accurate recesses 23, 23 adjacent to their proximal ends so that the resilient legs 20 are resiliently deformable inwardly toward each other. Each of the resilient legs 20 terminates in an enlarged locking hoot 24 projecting laterally outwardly for locking engagement with a C-shaped locking lug, later described, of the socket 3 when the legs 20 are snapped with the locking lug.

The plug 2 of the foregoing construction is assembled with the retainer base 1 by inserting the head portion 19 into the guide grooves 11 from the front end portions 13 of the retainer base 1. The thus-assembled plug 2 is slidably movable along the guide grooves 11. A rearward movement of the plug 2 relative to the retainer base 1 is limited when the abutment ridge 21 engages the arms 12*b* of the respective stoppers 12.

When the second belt B2 is to be secured to the plug 2, the plug 2 is moved forwardly until the head portion 19 is disposed forwardly of the slit 9 in the retainer base 1. Then a free end of the second belt B2 is passed through the slit 9 from the front side of the connecting bar 5. The plug 2 is moved rearwardly until the abutment ridge 21 abuts against the stoppers 12 in which instance the slit 22 in the head portion 19 is disposed immediately above the slit 9 in the retainer base 1. The belt free end is passed upwardly through the slit 22 in the plug 2 and then bent rearwardly away from the abutment ridge 21, thereby looping around the rear part of the head portion 19. The looped or folded belt end is stitched, so the second belt B2 is secured to the plug 2.

Figure 8:
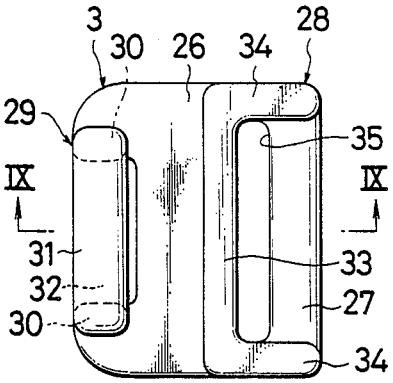
FIG. 8 is a plan view of a socket of the buckle assembly.
Figure 9:
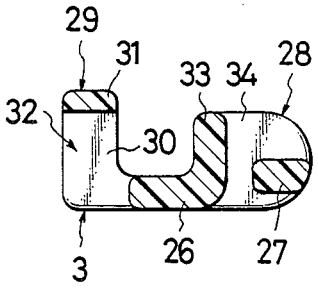
FIG. 9 a cross-sectional view taken along line IX—IX of FIG. 8.

The socket 3, as shown in FIGS. 8 and 9, has a generally rectangular shape of the same width as the retainer base 1 and includes a thin engagement portion 26 engageable with the stepped retainer portion 14 of the retainer base 1 and a thick connecting portion 28 for attachment to a third belt B3 (indicated by phantom lines in FIG. 2). The thin engagement portion 26 includes a generally C-shaped locking lug 29 loosely receivable in the aperture 10 in the retainer base 1. The C-shaped locking lug 29 includes a pair of parallel spaced upstanding legs 30, 30 projecting upwardly from the front edge of the engagement portion 26 and a transverse head 31 interconnecting upper ends of the upstanding legs 30, 30 so as to define therebetween an opening or channel 32 into which the resilient legs 20, 20 of the plug 2 are snapped. The thick connecting portion 28 includes an upstanding transverse rib 33 extending upwardly from the rear end of the engagement portion 26, a pair of side plates 34, 34 extending rearwardly perpendicularly from opposite ends of the transverse rib 33, and a transverse connecting bar 27 interconnecting rear ends of the side plates 34, 34. There is defined between the transverse rib 33 and the connecting bar 27 a slit 35 for the passage therethrough of the third belt B3. The C-shaped locking lug 29 is spaced from the transverse rib 33 by a distance which is slightly larger than the width of the guide bar 8.

The socket 3 is attached to the third belt B3 by looping a free end of the belt B3 around the connecting bar 27 from the underside of the latter. The looped belt end is then stitched to the web of the belt B3 in the manner as shown in FIG. 2.

To couple the retainer base 1 and the socket 3 by the plug 2, the plug 2 is moved rearwardly until its abutment ridge 21 engages the stoppers 12 of the retainer base 1 to thereby open the aperture 10. Then the locking lug 29 is inserted into the aperture 10 from the bottom of the retainer base 1 until the engagement portion 26 of the socket 3 engages flatwise against the lower surface 8*b* of the guide bar 8 and against the lower surfaces 13*b* of the front end portions 13 of the side plates 6. Thereafter, the abutment ridge 21 is forced by the user's forefinger to move the plug 2 forwardly along the guide grooves 11 while the user's thumb is being received between the projections 17 on the retainer base 1. The forward movement of the plug 2 causes the resilient legs 20 to be forced into the opening 32 in the C-shaped locking lug 29 on the socket 3 until the locking feet 24 are brought into interlocking engagement with the respective upstanding legs 30, 30 of the locking lug 29. With this snap fit of the resilient legs 20 with the locking lug 29, the retainer base 1 is firmly connected with the socket 3 against accidental detachment.

Since the plug 2 is slidably mounted on the retainer base 1, connection of the retainer base 1 and the socket 3 can be achieved only by displacing the plug 2 along the guide grooves 11 toward the socket 3. The buckle assembly of the foregoing construction, therefore, can be assembled quickly with utmost ease. Furthermore, the locking feet 24 on the resilient legs 20 are hooked with the locking legs 30 of the C-shaped locking lug 29 to thereby retain the retainer base 1 and the socket 3 in firmly coupled condition against accidental separation.

When the retainer base 1 is to be detached from the socket 3, the second belt B2 is pulled to move the plug 2 rearwardly toward the stoppers 12. With this forcible rearward movement of the plug 2, the locking feet 24 are released from interlocking engagement with the locking lug 29. The rearward movement of the plug 2 is limited when the abutment ridge 21 impinges on the arms 12*b* of the respective stoppers 12. With the stoppers 12 thus provided, the plug 2 is prevented from being removed from the retaining base 1 when the retainer base 1 is uncoupled from the socket 3. The L-shaped stoppers 12 are resiliently deformable inwardly toward each other, thereby absorbing the shock force when the abutment ridge 21 abuts against the stoppers 12.

Figure 10:
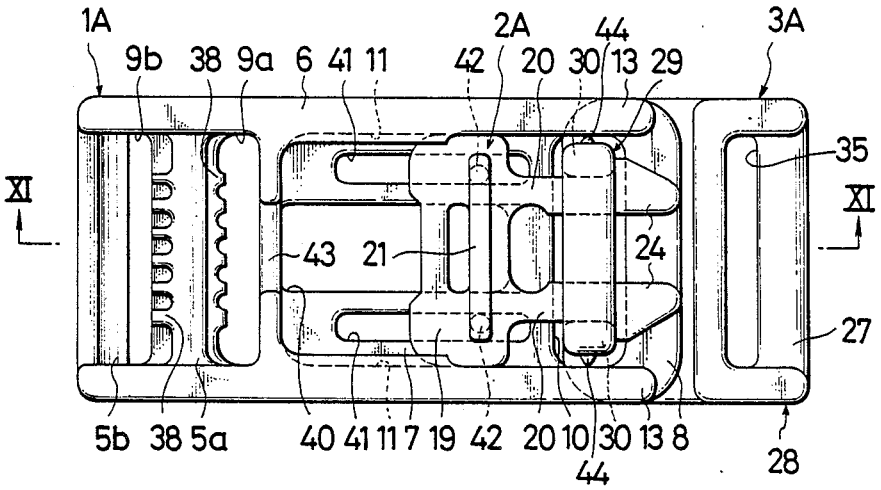
FIG. 10 is a plan view of a modified buckle assembly according to invention.
Figure 11:
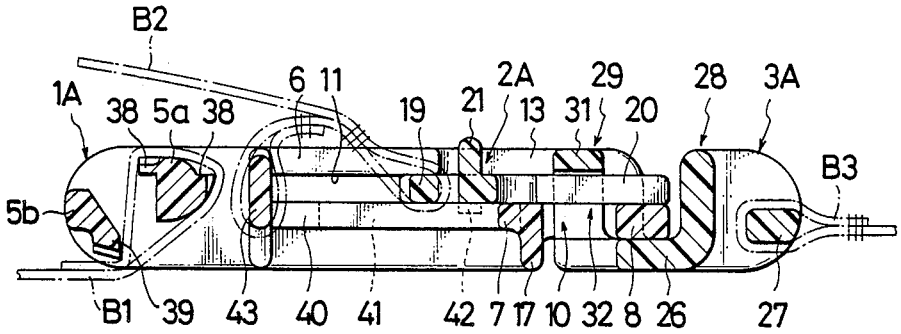
FIG. 11 is a cross-sectional view taken along line XI—XI of FIG. 10.

A modified buckle assembly shown in FIGS. 10 and 11 is similar to the buckle assembly of the foregoing embodiment but differs therefrom in that a retainer base 1A includes a transverse crossbar 5*a* disposed between a transverse connecting bar 5*b* and a support plate 7 for releasably holding an end portion of the first belt B1. The crossbar 5*a* has a pair of toothed locking edges 38, 38, one of which projects toward the support plate 7, the other locking edge 38 projecting opposite to the first-mentioned locking edge 38 for retaining the belt end firmly in position against loosening. The connecting bar 5*b* has a toothed locking edge 39 facing downwardly and frictionally engageable with the belt end portion looping around the crossbar 5*a* so as to retain the looped belt end portion in position against displacement.

The support plate 7 of the retainer base 1A has the same length as a plug 2A and also has formed therein a central longitudinal opening 40 for the passage therethrough of a second belt B2, and a pair of longitudinal guide slots 41, 41 disposed on opposite sides of the central opening 40 and extending along the central opening 40. The plug 2A includes a pair of guide pins 42, 42 projecting downwardly from a head portion 19 of the plug 2A. The guide pins 42 are slidably received in the guide slots 41, respectively, to ensure that the plug 2A is slidably movable along the guide grooves 11 without causing lateral displacement or wobbling relative to the retainer base 1.

The retainer base 1A further includes a vertical stopper ridge 43 extending transversely along the rear edge of the support plate 7. The stopper ridge 43 is recessed in its upper and lower surfaces, which recessed portions are disposed in alignment with the central opening 40 and have substantially the same width as the second belt B2.

The second belt B2 is secured to both the plug 2A and the retainer base 1A in such a manner that a free end portion of the second belt B2 after having looped successively around a rear section of the plug 2A and the stopper ridge 43 of the retainer base 1A is sewn to the web of the second belt B2 at portions located between the stopper ridge 43 and the head portion 19 of the plug 2A while allowing the required sliding movement of the plug 2A to couple and uncouple the retainer base 1A and a socket 3A, but preventing full separation of the plug 2A from the retainer base 1A.

The retainer base 1A has a pair of confronting guide grooves 11, 11 extending longitudinally between the stopper ridge 43 and an intermediate portion of the support plate 7 such that only a rear end part of the head portion 19 of the plug 2A is received in the guide grooves 11 when the retainer base 1A and the socket 2A are coupled together by the plug 2A.

The socket 3A includes a pair of guide projections 44, 44 integral with and disposed on outer surfaces of the respective upstanding legs 30 of the C-shaped locking lug 29 and frictionally engageable with a peripheral edge of the aperture 10 and also with opposed inner surfaces of a pair of front end portions 13 of the side plates 6 for holding the retainer base 1A and the socket 3A in pre-assembled condition when the locking lug 39 of the socket 3A is received in an aperture 10 in the retainer base 1A.

Figure 12:
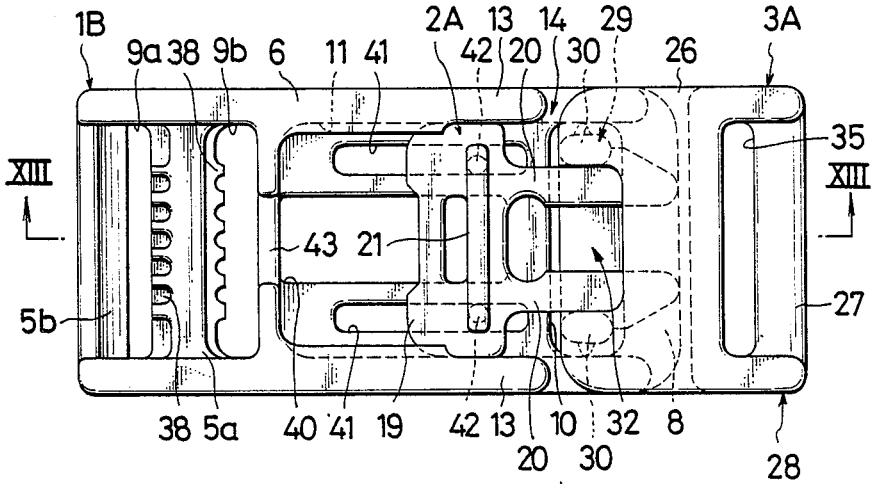
FIG. 12 is a plan view of a further modified form of the buckle according to the present invention.
Figure 13:
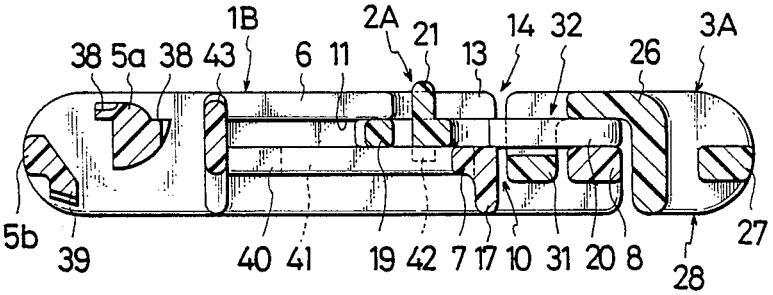
FIG. 13 is a cross-sectional view taken along line XIII—XIII of FIG. 12.

FIGS. 12 and 13 show a modified form of the buckle assembly according to the present invention. The modified buckle assembly is substantially the same as the buckle assembly shown in FIGS. 10 and 11 with the exception that a retainer base 1B has an additional stepped retainer portion 14 formed at the upper side of the front end portions 13 of the side plates 6. With this retainer portion 14, the C-shaped locking lug 29 of the socket 2A can be inserted into the aperture 10 in the retainer base 1B from the upper side of the retainer base 1B.

Obviously, various modifications and variations of the present invention are possible in the light of the above teaching. It is therefore to be understood that within the scope of the appended claims the invention may be practiced otherwise than as specifically described.

What is claimed is:

1. A buckle assembly for releasably connecting three belts, comprising:

(a) a retainer base for being attached to a first belt and having an aperture extending through said retainer base in a direction perpendicular to a plane of said retainer base;

(b) a plug for being attached to a second belt and slidably mounted on said retainer base, said plug having a pair of resilient legs and slidably movable between a first position in which said resilient legs are retracted from said aperture, and a second position in which said resilient legs extend across said aperture; and (c) a socket for being attached to the third belt and having an upstanding generally C-shaped locking lug receivable in said aperture in said retainer base from said direction when said plug is disposed in said first position, said C-shaped locking lug being snappingly engageable with said resilient legs to couple said retainer base and said socket when said plug is disposed in said second position.

2. A buckle assembly for releasably connecting three belts, comprising:

(a) a retainer base for being attached to a first belt and having an aperture;

(b) a plug for being attached to a second belt and slidably mounted on said retainer base, said plug having a pair resilient legs and slidably movably between a first position in which said resilient legs are retracted from said aperture, and a second position in which said resilient legs extend across said aperture; and (c) a socket for being attached to the third belt and having an upstanding generally C-shaped locking lug receivable in said aperture in said retainer base when said plug is disposed in said first position said C-shaped locking lug being snappingly engageable with said resilient legs to couple said retainer base and said socket when said plug is disposed in said second position, said retainer base including a pair of parallel spaced side plates interconnected at their one end with a transverse guide bar, and a support plate extending between said side plates and spaced from said guide bar so as to define therebetween, said aperture, said side plates having a pair of confronting longitudinal guide grooves, respectively, said plug including a head portion from which said resilient legs extend in a common direction, said head portion being slidably received in said guide grooves.

3. A buckle assembly according to claim 2, said support plate having an upper surface extending in flush with an upper surface of said guide bar, said guide grooves extending in a plane immediately above said upper surfaces of said support plate and said guide bar.

4. A buckle assembly according to claim 2, said guide bar projecting outwardly from said one end of said side plates.

5. A buckle assembly according to claim 2, said support plate having in its upper surface a recessed portion extending from an intermediate portion of said support plate in a direction away from said guide bar for receiving therein a portion of the second belt, said recessed portion including a vertical shoulder facing away from said guide bar and engageable with the second belt to limit movement of said plug in a direction from said first position toward said second position.

6. A buckle assembly according to claim 2, said side plates having front end portions joined with said guide bar and spaced from one another by a distance substantially equal to the distance between said guide grooves, said front end portions being recessed in at least one of their upper and lower surfaces to provide a recessed retainer portion extending in flush with a corresponding one of upper and lower surfaces of said guide bar.

7. A buckle assembly according to claim 2, said support port plate having on its underside a pair of spaced projections.

8. A buckle assembly according to claim 2, said retainer base further including at least one stopper engageable with a portion of said plug for limiting sliding movement of said plug in a direction away from said aperture.

9. A buckle assembly according to claim 8, said stopper being disposed on the opposite end of each said side plate and projecting therefrom toward the opposite side plate, said head portion of said plug having an abutment ridge engageable with said stopper.

10. A buckle assembly according to claim 9, said stopper being L-shaped and resiliently deformable, said L-shaped stopper including a base portion extending inwardly perpendicularly from said side plate and an arm extending from a front end of said base portion toward said aperture in parallel spaced relation to said side plate.

11. A buckle assembly according to claim 8, said stopper extending along a rear edge of said support plate remote from said aperture and engageable with said head portion of said plug.

12. A buckle assembly according to claim 2, said support plate having an elongate central opening for the passage therethrough of the second belt, said stopper having a central recessed portion extending in alignment with said central opening.

13. A buckle assembly according to claim 2, said retainer base, said plug and said socket being molded of synthetic resin.

14. A buckle assembly for releasably connecting three belts, comprising:

(a) a retainer base for being attached to a first belt and having an aperture;

(b) a plug for being attached to a second belt and slidably mounted on said retainer base, said plug having a pair of resilient legs and slidably movable between a first position in which said resilient legs are retracted from said aperture, and a second position in which said resilient legs extend across said aperture; and (c) a socket for being attached to the third belt and having an upstanding generally C-shaped locking lug receivable in said aperture in said retainer base when said plug is disposed in said first position, said C-shaped locking lug being snappingly engagable with said resilient legs to couple said retainer base and said socket when said plug is disposed in said second position, said support plate having at least one guide slot extending parallel with said guide grooves, said head of said plug having a guide pin slidably received in said guide slot.

15. A buckle assembly for releasably connecting three belts, comprising:

(a) a retainer base for being attached to a first belt and having an aperture;

(b) a plug for being attached to a second belt and slidably mounted on said retainer base, said plug having a pair of resilient legs and slidably movable between a first position in which said resilient legs are retracted from said aperture, and a second position in which said resilient legs extend across said aperture; and (c) a socket for being attached to the third belt and having an upstanding generally C-shaped locking lug receivable in said aperture in said retainer base when said plug is disposed in said first position, said C-shaped locking lug being snappingly engageable with said resilient legs to couple said retainer base and said socket when said plug is disposed in said second position, said socket having a pair of guide projections integral with and disposed on opposite sides of said C-shaped locking lug, said guide projections being frictionally engageable with a peripheral edge of said aperture when said locking lug is received in said aperture.

* * * * *